United States Patent [19]

Ostrowsky

[11] 4,206,851

[45] Jun. 10, 1980

[54] TAMPERPROOF CLOSURE

[75] Inventor: Efrem M. Ostrowsky, Highland Park, Ill.

[73] Assignee: Ethyl Products Company, Baton Rouge, La.

[21] Appl. No.: 14,626

[22] Filed: Feb. 23, 1979

[51] Int. Cl.[2] ..... B65D 41/34

[52] U.S. Cl. ..... 215/246; 215/252

[58] Field of Search ..... 215/246, 252

[56] References Cited

U.S. PATENT DOCUMENTS

| | | | |
|---|---|---|---|
| 2,608,334 | 8/1952 | Knocke | 53/488 X |
| 3,329,295 | 7/1967 | Fields | 215/252 |
| 3,438,528 | 4/1969 | Fields | 215/252 |
| 3,441,161 | 4/1969 | Van Baarn | 215/252 X |
| 3,673,761 | 7/1972 | Leitz | 215/252 X |
| 3,812,991 | 5/1974 | Wurl | 215/252 |
| 3,861,551 | 1/1975 | Hannon | 215/252 |
| 4,033,472 | 7/1977 | Aichinger | 215/256 |
| 4,126,240 | 11/1978 | Brach | 215/252 |

*Primary Examiner*—Donald F. Norton

*Attorney, Agent, or Firm*—Donald L. Johnson; John F. Sieberth; Edgar E. Spielman, Jr.

[57] ABSTRACT

A thermoplastic tamperproof closure for fitment to a container is disclosed. The container has a threaded neck and an outwardly extending flange beneath the neck threads. The closure features a top wall with an annular sidewall downwardly depending therefrom and having about its inside surface a thread for cooperation with the container thread. Attached to the sidewall by a plurality of spaced apart, non-fracturable ribs is a fracturable band which will fit in a position of interference under the container flange. This fit is achieved by applying heat to the ribs and band, after the closure is fitted to the container, causing the band and ribs to shrink to the position of interference.

15 Claims, 6 Drawing Figures

TAMPERPROOF CLOSURE

BACKGROUND OF THE INVENTION

The utilization of tamperproof closures on containers is well known in the art. A particularly ubiquitous tamperproof package is one which has a closure fittable to a container with a threaded neck and an outwardly extending flange beneath the neck thread. The closure screws onto the container thread and has a non-fracturable bead attached to the closure by a plurality of fracturable ribs. This style closure is generally fitted to the container so that the bead will achieve a position of interference under the container flange. Screwing the closure from the container results in axial movement of the main closure body which movement cannot be followed by the non-fracturable rib as it is in interference with the container flange. As more torque is applied to the closure, the fracturable ribs fracture allowing the closure to separate from the bead and be removed from the container. An example of such a tamperproof package is shown in U.S. Pat. No. 3,438,528.

Another style of tamperproof package is the one disclosed in U.S. Pat. No. 4,126,240. A closure in this style package utilizes a bead which is separated from the main closure body upon fitment of the closure to the container. Final fitment of the closure to the container results in a plurality of tongues engaging the separated bead so that when the closure is removed from the container body the separated bead is fractured thereby giving an indication that the package has been tampered with.

While the above systems have merit, they have one serious drawback; i.e. a ring or bead of plastic remains with the container after the main portion of the closure has been removed from the container. This oftentimes results in the user of these style packages dropping the separated bead into the product as it is dispensed to a cup or glass. The user of the package must then attempt to locate and remove the bead from the dispensed product resulting in aggravation and possible contamination of the product. In those instances where the user does not note the falling of the bead into his cup or glass there is a very real danger that injestion of the bead will occur with all of its attenuant medical difficulties.

Therefore it is an object of this invention to provide a tamperproof package which utilizes a closure that retains as a unitary piece its tamper-indicating parts. It is a further object of this invention to provide such a closure which may be utilized either with or without a sealing liner.

THE INVENTION

This invention relates to a tamperproof package featuring a thermoplastic closure for fitment to a container having a body portion, a threaded neck portion and an outwardly extending flange directly beneath the neck thread. The closure has (A) a top wall; (B) an annular sidewall downwardly depending from the top wall and having about its inside surface a thread for cooperation with the container thread; and (C) an annular band or bead, (i) attached to the sidewall by a plurality of spaced apart ribs which are of sufficient length so that the band is below the annular flange when the closure is fitted to the container and (ii) having at least one facturable area of reduced strength so that the fracturable area is fractured as the closure is removed from the container. The band and ribs are shrinkable upon the application of heat thereto so that the band will nest in a position of interference under the annular flange when the closure is fitted to the container.

Preferably the closure of this invention is made of a thermoplastic selected from polypropylene, polyethylene terephthalate or high density polyethylene. The closure can be made by conventional, well known injection molding techniques, the design of the closure lending itself readily to such form of manufacture. The container can be either of thermoplastic material or glass. In the beverage industry thermoplastic material is preferred for the container with polypropylene or polyethylene terephthalate being most highly preferred.

The closure may use a sealing liner to effect a liquid-tight seal when the closure is tightened to the container. If a sealing liner is not compatible with the packager's requirements, the closure of this invention can be provided with a linerless seal such as an annular sealing fin extending downwardly from the inside top wall of the closure. Utilization of such sealing fins is well known to those skilled in the art and the particular fin shown in the drawings is only one of many different fin designs which could be used with the closure of this invention.

These and other features contributing satisfaction is use and economy of manufacture will be more fully understood when taken in connection with the description of a preferred embodiment of this invention and the accompanying drawings in which identical numerals refer to identical parts and in which.

Figure 1:
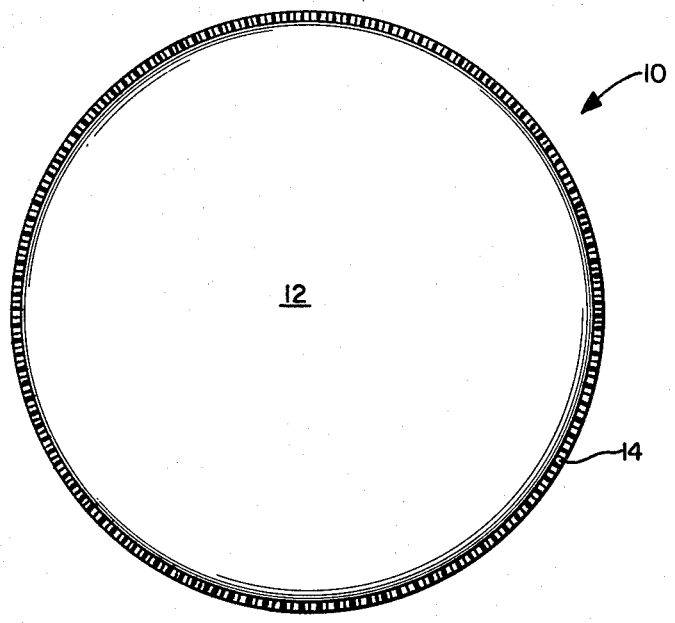
FIG. 1 is a top plan view of a closure of this invention.
Figure 2:
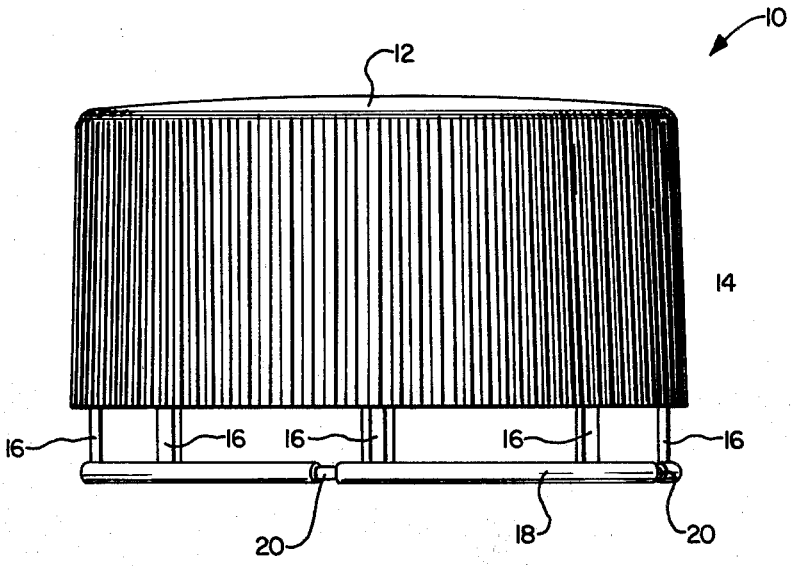
FIG. 2 is a side elevational view of the closure shown in FIG. 1.
Figure 3:
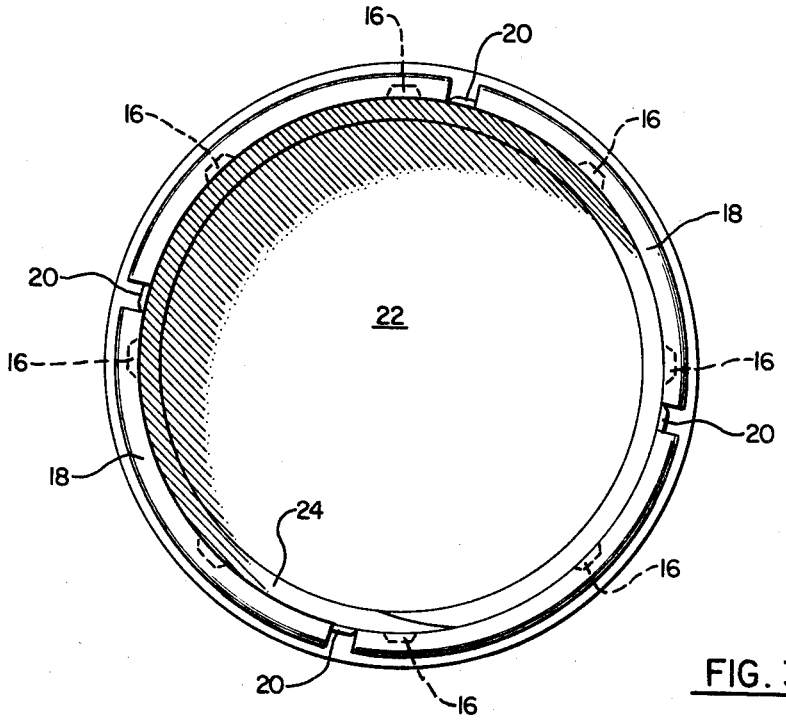
FIG. 3 is a bottom plan view of the closure shown in FIG. 1.
Figure 4:
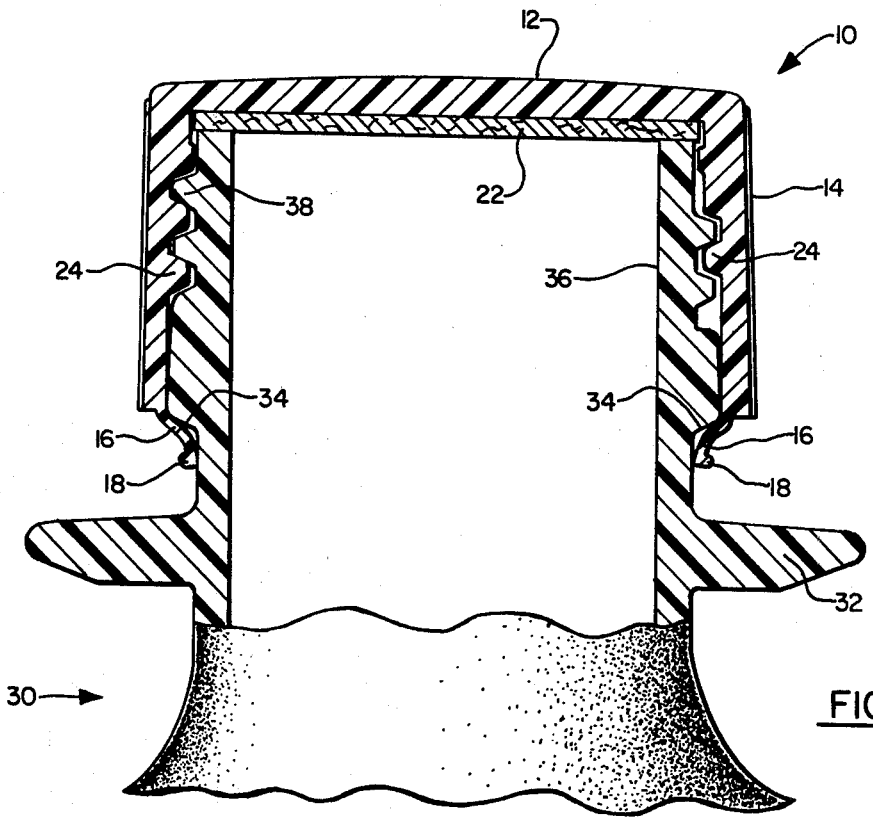
FIG. 4 is a partial sectional view of a tamperproof package of this invention utilizing the closure shown in FIG. 1 with a sealing liner.

Referring now to FIGS. 1–4, it can be seen that a closure of this invention, generally designated by the numeral 10, is fittable to a container, generally designated by the numeral 30 in FIG. 4. Closure 10 has a top wall 12 and an annular downwardly depending sidewall 14. Sidewall 14, for the embodiment shown, has a serrated outside surface. By having such a surface, the user of the closure of this invention is given a better grip for applying the necessary torque to remove and replace the closure 10 on container 30. It is understood that a smooth outside surface, or for that matter, any other outside surface treatment is within the scope of this invention, the exact configuration of the outside surface being left up to the user of closure 10. In FIGS. 3 and 4 there is shown closure thread 24 which is about the inside surface of sidewall 14. Closure thread 24 cooperates with container thread 38 to tighten closure 10 onto container 30.

Seated against the inside surface of top wall 12 is sealing liner 22. Sealing liner 22 can be any of the multitude of liners commercially available which will effect a liquid-tight seal for the package shown in the drawings. Downwardly depending from the lowermost end of sidewall 14 is a plurality of non-fracturable ribs 16. These ribs have attached at their other end fracturable band 18 which has, for the embodiment shown in the drawings, a plurality of fracturable areas 20 of reduced strength. Fracturable areas 20 are dimensioned or weakened to insure that at leat one of the areas will fracture upon the application of opening torque to closure 10.

Ribs 16 are non-fracturable and therefore are dimensioned to withstand the stresses placed upon them prior to the fracture of fracturable areas 20. A single fracturable area may be used, however multiple fracturable areas may be used depending upon the desires of the packager. Fracturable areas 20 are preferably located so that not more than one fracturable area will exist between any two sets of ribs 16. Each fracturable area 20 can be located anywhere betwen ribs 16; e.g. fracturable area 20 may be located closer to one rib than the other or may be located equidistant from the ribs it is between. The embodiment shown in the drawings shows fracturable area 20 being located closer to one rib than the other thus providing a larger fracturable piece of bead 18 which, in some cases, is more visible to the user of closure 10.

Figure 6:
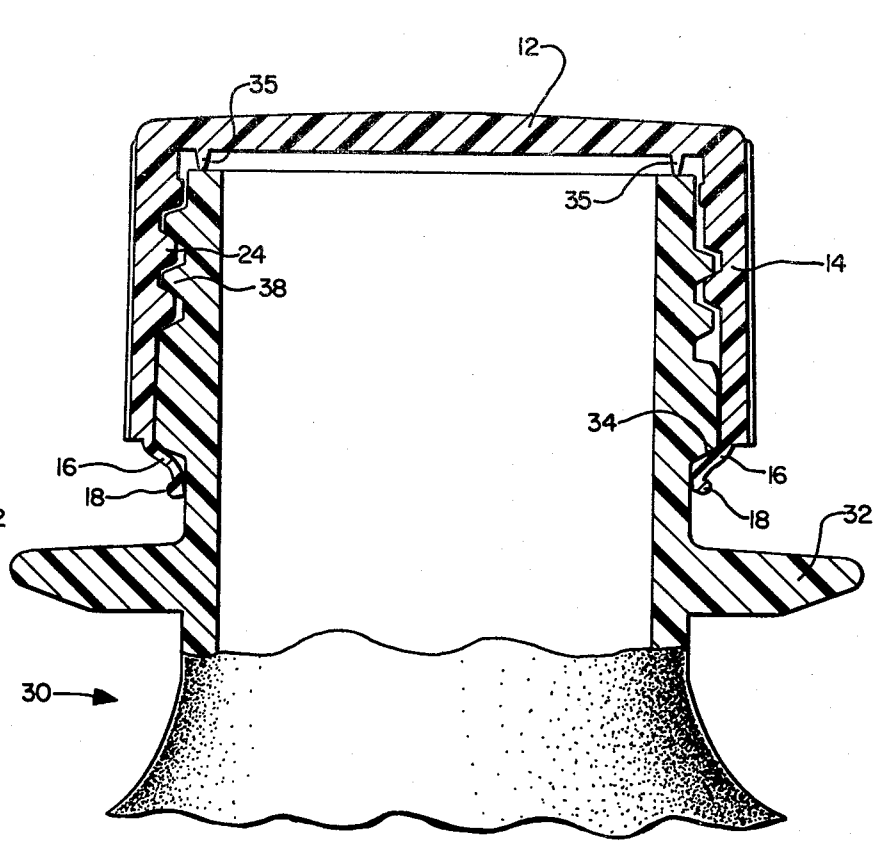
FIG. 6 is a partial, sectional view of a package of this invention utilizing the closure shown in FIG. 1 with a sealing fin being provided.
Figure 5:
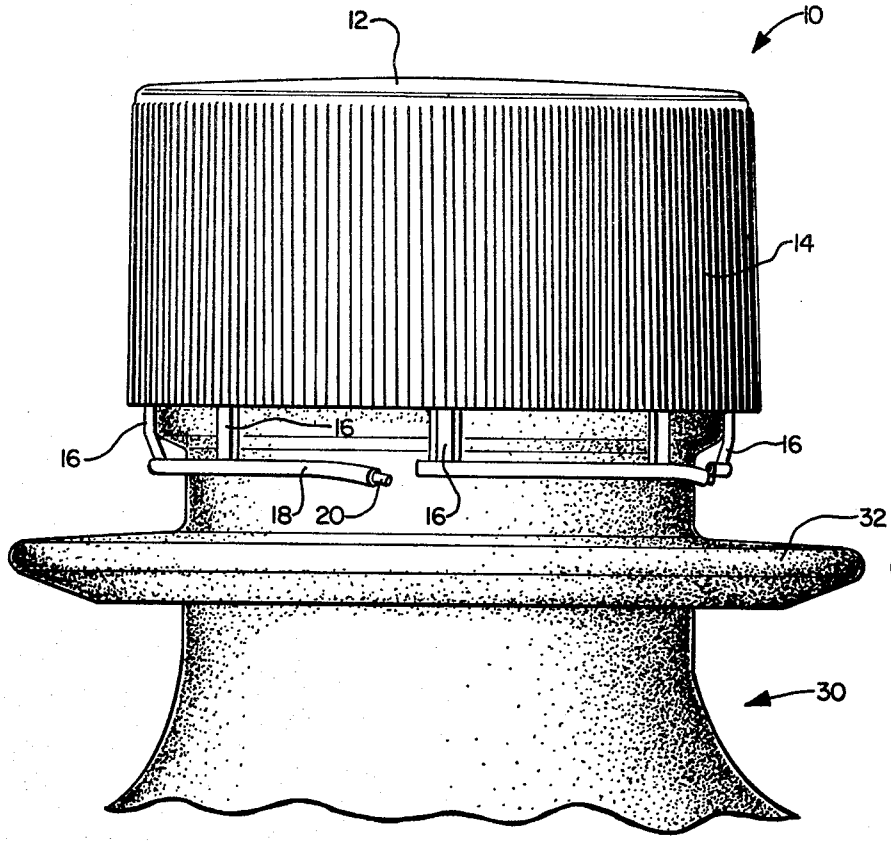
FIG. 5 is a partial, side elevational view of the packages shown in FIGS. 4 and 6 showing the fracturing of the band as the closure is removed from the container.

Another embodiment is shown in FIG. 6 and is nearly identical to the embodiment shown in FIG. 1–4, identical numbers identifying identical parts. The one difference is that the closure shown in FIG. 5 does not utilize a sealing liner but rather utilizes a sealing fin 35. Sealing fin 35 is annular in shape and is dimensioned so that it will bear upon the uppermost extent of the container neck. As mentioned previously, the exact configuration of sealing fin 35 can be of any convenient design, the package of this invention not being limited to the sealing fin design shown in FIG, 5. For example, sealing fin 35, instead of being a single fin, may be a a bifurcated fin. Fin 35 may also be designed to form a liquid-tight seal with the inside surface of the container neck rather than seating upon the top of the container neck as shown in FIG. 5. Many variations of sealerless liners known to those skilled in the art may be utilized as long as they do not interfere with the tamperproof qualities of the package of this invention.

Container 30, as before mentioned, may be of glass or any suitable thermoplastic material. Container 30 can be conventionally provided with flange 32 which will be utilized as a convenient way of holding container 30 on the fill line. Beneath container thread 38 there is provided an annular outwardly extending flange 34. Outward flange 34 extends radially outward sufficient to insure an interference fit between itself and bead 18 as hereinafter described.

In operation the package of this invention is easily assembled. Container 30, after leaving the fill line, is sent to a capping station wherein closure 10 is screwd onto container 30 until a liquid-tight seal is achieved. Note in FIG. 2 that closure 10 at this stage will have a configuration wherein ribs 16 are nearly vertical and band 18 has a diameter which is preferably larger than the diameter of container thread 38. By having this relationship between diameters there is little or no interference from band 18 or rib 16 as closure 10 is screwed onto container 30.

After closure 10 has been fitted to container 30, heat is applied to ribs 16 and band 18. Ribs 16 and bead 18 are of sufficient thinness so that they will soften somewhat and shrink inwardly upon cooling so that band 18 is in a position of interference under annular flange 34 as is shown in FIGS. 4 and 5. At this point band 18 will have a diameter substantially smaller than the outside diameter of flange 34.

Any attempt to remove closure from container 30 will result in axial movement of closure 10 thereby applying a stretching force to band 18 as it tries to expand over flange 34. When this occurs, at least one of fracturable areas 20 will fracture to accommodate this force of expansion. If a plurality of fracturable areas 20 are present, there may be multiple fracturing. Whether a single fracturable area 20 is utilized or a plurality of fracturable areas is utilized, the fracture is easily viewable and thus will be an alert that the package has been tampered with.

Since ribs 16 do not fracture, band 18 will still be attached to closure 10 thereby obviating the problem of band 18 falling into the product as it is dispensed. Even though ribs 16 are shown to have an essentially rectangular shape it is to be understood that they may be shaped in any manner found convenient by the user of closure 10, e.g. columnar shaped. Container flange 34 may also have different configurations, it only being important that the position of interference previously mentioned is achieved by band 18 with flange 34.

What is claimed is:

1. A thermoplastic, tamperproof closure for fitment to a container, said container having a threaded neck and an outwardly extending flange beneath said neck thread, said closure comprising:

a. a top wall;

b. an annular sidewall downwardly depending from said top wall and having about its inside surface a thread for cooperation with said container thread; and c. an annular band, i. attached to said sidewall by a plurality of spaced apart ribs, said ribs being of sufficient length so that said band is below said annular flange when said closure is fitted to said container, and ii. having at least one fracturable area of reduced strength so that said fracturable area is fractured as said closure is removed from said container, said band and said ribs being shrinkable upon the application of heat thereto so that said band will nest in a position of interference under said annular flange when said closure is fitted to said container.

2. The closure of claim 1 wherein said closure additionally has a sealing liner seated against the inside surface of said top wall.

3. The closure of claim 1 wherein said closure additionally has an annular sealing fin downwardly depending from said top wall.

4. The closure of claim 1 wherein said closure is made of polypropylene, polyethylene terephthalate or high density polyethylene.

5. The closure of claim 2 wherein said closure is made of polypropylene, polyethylene terephthalate or high density polyethylene.

6. The closure of claim 3 wherein said closure is made of polypropylene, polyethylene terephthalate or high density polyethylene.

7. The closure of claim 1 wherein there is a plurality of fracturable areas with no more than one fracturable area being located between any two of said ribs.

8. A tamperproof package having a container and a closure fittable thereto, said container comprising:

a. a body portion;

b. a threaded neck portion; and

United States Patent [19]

Dunn et al.

[11] 4,206,852

[45] Jun. 10, 1980

[54] LINERLESS CLOSURE FOR PRESSURIZED CONTAINER

[75] Inventors: Lloyd G. Dunn; Elmer E. Pohlenz, both of Richmond, Ind.

[73] Assignee: Aluminum Company of America, Pittsburgh, Pa.

[21] Appl. No.: 6,597

[22] Filed: Jan. 26, 1979

[51] Int. Cl.[2] ..... B65D 41/34

[52] U.S. Cl. ..... 215/252; 215/270; 215/307; 215/354

[58] Field of Search ..... 215/252, 260, 270, 307, 215/329, 320, 354

[56] References Cited

U.S. PATENT DOCUMENTS

| | | | |
|---|---|---|---|
| 3,110,411 | 11/1963 | Golde | 215/329 |
| 3,209,934 | 10/1965 | Salminen | 215/320 |
| 3,595,418 | 7/1971 | Adcock | 215/329 |
| 3,673,761 | 7/1972 | Leitz | 215/252 X |

FOREIGN PATENT DOCUMENTS

| | | | |
|---|---|---|---|
| 670896 | 9/1963 | Canada | 215/260 |

*Primary Examiner*—Donald F. Norton
*Attorney, Agent, or Firm*—David W. Brownlee

[57] ABSTRACT

A linerless plastic closure is disclosed which is adapted to seal containers for pressurized contents such as carbonated beverages and which utilizes a plug configuration that is designed to expand under pressure. This is accomplished by making the plug in the form of a disc spring washer with tubular supports joining it to the top of the closure. Pressure against the disc spring washer increases the pressure of the seal against the interior surface of the bottle mouth to provide a reliable seal. The closure may have a slot through the threads on the closure to permit rapid escape of gases from the container during removal of the closure from the container. In this way, dangerous blow-off of the closure from a container is substantially eliminated.

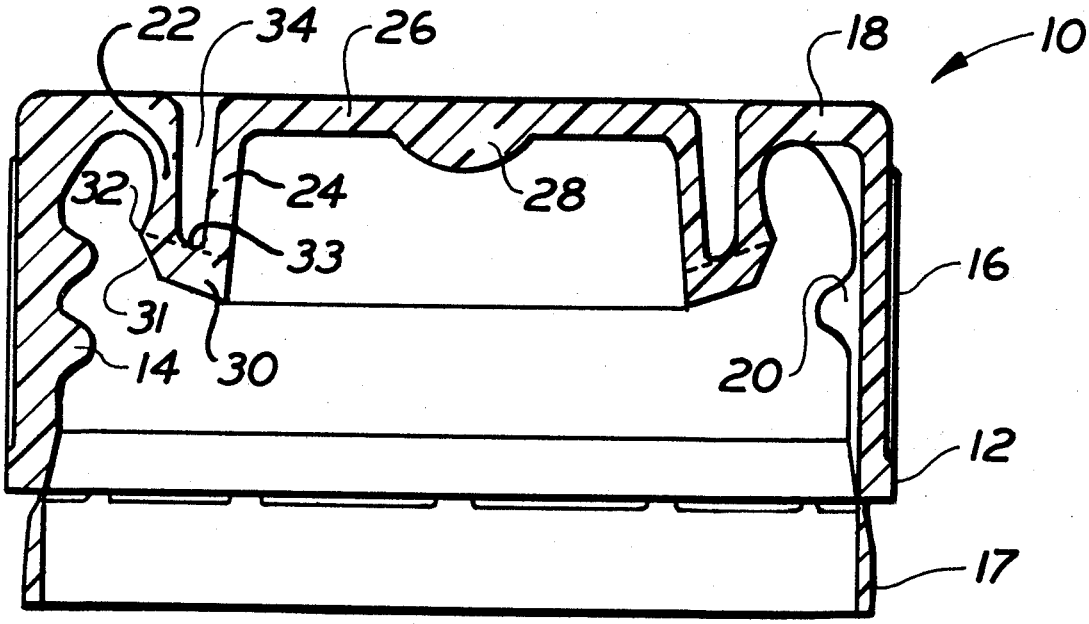

11 Claims, 4 Drawing Figures